United States Patent [19]

Jin

[11] Patent Number: 4,475,961

[45] Date of Patent: Oct. 9, 1984

[54] HIGH REMANENCE IRON-MANGANESE ALLOYS FOR MAGNETICALLY ACTUATED DEVICES

[75] Inventor: Sungho Jin, Gillette, N.J.

[73] Assignee: AT&T Bell Laboratories, Murray Hill, N.J.

[21] Appl. No.: 468,089

[22] Filed: Feb. 22, 1983

Related U.S. Application Data

[60] Division of Ser. No. 349,161, Feb. 16, 1982, , which is a continuation of Ser. No. 116,759, Jan. 30, 1980, abandoned.

[51] Int. Cl.[3] ..... H01F 1/04

[52] U.S. Cl. ..... 148/31.55; 148/31.57

[58] Field of Search ..... 148/31.55, 31.57, 102, 148/120, 121; 75/122, 123 N

[56] References Cited

U.S. PATENT DOCUMENTS

| | | | |
|---|---|---|---|
| 1,975,746 | 10/1934 | Hall | 148/121 |
| 3,301,720 | 1/1967 | Griest | 148/31.55 |
| 3,624,568 | 11/1971 | Olsen et al. | 335/153 |
| 3,769,100 | 10/1973 | Watanabe et al. | 148/120 |
| 3,783,041 | 1/1974 | Tokushima | 148/120 |
| 4,222,020 | 9/1980 | Jameel et al. | 335/151 |

FOREIGN PATENT DOCUMENTS 1369509 10/1974 United Kingdom .

OTHER PUBLICATIONS

Roberts, Effect of Transformation Substructure on the Strength and Toughness of Fe-Mn Alloys, Met. Trans., vol. 1, Dec. 1970, pp. 3287-3294.

Walters, Transformations and Heterogeneity in the Binary Alloys of Iron and Manganese, Tran. Soc. for Steel Treating, vol. 21, No. 10, 1933, pp. 1002-1015.

Fedash, Study of Coercivity of Cold Worked and Annealed Alloys, The Physics of Metals and Metallography, vol. 4, No. 2, 1957, pp. 50-55.

Ogawa, Semihard Magnetic Materials of Fe-Cu-Mn System, J. Appl. Phy., vol. 44, No. 4, Apr. 1973, pp. 1810-1812.

*Permanent Magnet Design and Application Handbook*, Cahner Books, 1976, L. R. Moskowitz, pp. 211-220.

Pinnel, Magnetic Material for Dry Reed Contacts, IEEE Trans. Mag., vol. MAG-12, No. 6, Nov. 1976, pp. 789-794.

Hansen, *Constitution of Binary Alloys*, 2nd ed., 1958, pp. 664-667.

Bozorth, *Ferromagnetism*, 1951, pp. 234-236 and pp. 418-419.

Translation of "Kaltverformter Manganstahl als neuer Magnetwerkstoff", *Archiv fur das Eisenhuttenwesen*, vol. 15, No. 2, Aug. 1941, W. Jellinghaus, pp. 99-102.

Translation of "Cold Worked Fe-Mn Semihard Magnet Alloy", *Journal of the Japanese Institute of Metals*, vol. 34, No. 4, 1970, H. Kaneko et al., pp. 441-445.

*Primary Examiner*—John P. Sheehan

*Attorney, Agent, or Firm*—Peter A. Businger

[57] ABSTRACT

Magnetically actuated devices such as, e.g., switches and synchronizers typically comprise a magnetically semihard component having a square B-H hysteresis loop and high remanent induction. Among alloys having such properties are Co-Fe-V, Co-Fe-Nb, and Co-Fe-Ni-Al-Ti alloys which, however, contain undesirably large amounts of cobalt.

According to the invention, devices are equipped with a magnetically semihard, high-remanence Fe-Mn alloy which contains Mn in a preferred amount in the range of 3-25 weight percent whose remanence $B_r$(gauss) typically is greater than or equal to 20,000-500× (weight percent Mn), and whose squareness $B_r/B_s$ typically is greater than 0.95.

Magnets made from alloys of the invention may be shaped, e.g., by cold drawing, rolling, bending, or flattening and may be used in devices such as, e.g., electrical contact switches, hysteresis motors, and other magnetically actuated devices.

Preparation of alloys of the invention may be by a treatment of initial deformation, aging, deformation, and final aging.

6 Claims, 5 Drawing Figures

HIGH REMANENCE IRON-MANGANESE ALLOYS FOR MAGNETICALLY ACTUATED DEVICES

CROSS-REFERENCE TO RELATED APPLICATIONS

This is a divisional application of application Ser. No. 349,161, filed Feb. 16, 1982, now abandoned, which was a continuation application of application Ser. No. 116,759, filed Jan. 30, 1980, now abandoned.

TECHNICAL FIELD

The invention is concerned with magnetic devices and materials.

BACKGROUND OF THE INVENTION

Magnetically actuated devices may be designed for a variety of purposes such as, e.g., electrical switching, position sensing, synchronization, flow measurement, and stirring. Particularly important among such devices are so-called reed switches as described, e.g., in the book by L. R. Moskowitz, *Permanent Magnet Design and Application Handbook,* Cahners Books, 1976, pp. 211–220, in U.S. Pat. No. 3,624,568, issued Nov. 30, 1971 to K. M. Olsen et al., and in the paper by M. R. Pinnel, "Magnetic Materials for Dry Reed Contacts", *IEEE Trans. Mag.,* Vol. MAG-12, No. 6, November 1976, pp. 789–794. Reed switches comprise flexible metallic reeds which are made of a material having semihard magnetic properties as characterized by an essentially square B-H hysteresis loop and high remanent induction $B_r$; during operation reeds bend elastically so as to make or break electrical contact in response to changes in a magnetic field.

Among established alloys having semihard magnetic properties are Co-Fe-V alloys known as Vicalloy and Remendur, Co-Fe-Nb alloys known as Nibcolloy, and Co-Fe-Ni-Al-Ti alloys known as Vacozet. These alloys possess adequate magnetic properties; however, they contain substantial amounts of cobalt whose rising cost in world markets causes concern. Moreover, high cobalt alloys tend to be brittle, i.e., to lack sufficient cold formability for shaping, e.g., by cold drawing, rolling, bending, or flattening.

Relevant with respect to the invention are the book by M. Hansen, *Constitution of Binary Alloys,* 2nd edition, McGraw-Hill, 1958, pp. 664–667; the book by R. M. Bozorth, *Ferromagnetism,* Van Nostrand, 1951, pp. 234–236 and pp. 418–419; the paper by M. J. Roberts, "Effect of Transformation Substructure on the Strength and Toughness of Fe-Mn Alloys", *Met. Trans.,* Vol. 1, December 1970, pp. 3287–3294, the paper by F. M. Walters, Jr., "Transformations and Heterogeneity in the Binary Alloys of Iron and Manganese", *Trans. American Soc. for Steel Treating,* Vol. 21, No. 10, 1933, pp. 1002–1015, and the paper by G. M. Fedash, "Study of Coercivity of Cold-Worked and Annealed Iron Alloys", *The Physics of Metals and Metallography,* Vol. 4, No. 2, 1957, pp. 50–55. These references discuss phase transformations, mechanical properties, and coercivity of iron-rich Fe-Mn alloys. Semihard magnetic properties of Fe-Mn ternary and quaternary alloys are disclosed by W. Jellinghaus, "Kaltverformter Manganstahl als neuer Magnetwerkstoff", *Archiv fur das Eisenhuttenwesen,* Vol. 15, No. 2, August 1941, pp. 99–102, by H. Kaneko et al., "Cold Worked Fe-Mn Semihard Magnet Alloy", *Journal of the Japanese Institute of Metals,* Vol. 34, No. 4, 1970, pp. 441–445, and by K. Ogawa, "Semihard Magnetic Material of the Fe-Cu-Mn System", *J. App. Phys.,* Vol. 44, No. 4, April 1973, pp. 1810–1812.

SUMMARY OF THE INVENTION

According to the invention semihard magnetic properties are realized in Fe-Mn alloys which preferably comprise Fe and Mn in a combined amount of at least 98 weight percent and Mn in an amount in the range of 3–25 weight percent of such combined amount. Remanent magnetic induction $B_r$(gauss) of alloys of the invention is typically greater than or equal to a value of 20,000–500×(weight percent Mn) and their squareness ratio $B_r/B_s$ is greater than 0.7 and typically greater than or equal to 0.95.

Alloys of the invention characteristically exhibit an anisotropic two-phase or multiphase microstructure, particles and grains being elongated to have preferred aspect ratio of at least 8 and preferably at least 30. Preferred particle diameter or thickness is less than 8000 Angstrom and preferably less than 2000 Angstrom.

Magnets made from such alloys may be shaped, e.g., by cold drawing, rolling, bending, or flattening and may be used in devices such as, e.g., electrical contact switches, hysteresis motors, and other magnetically actuated devices.

Preparation of alloys of the invention may be by a treatment of initial deformation, aging, deformation, and final aging. Aging steps are preferably carried out at temperatures at which an alloy is in a two-phase or multiphase state. The second deformation step is preferably a step of uniaxial deformation.

DETAILED DESCRIPTION

Figure 1:
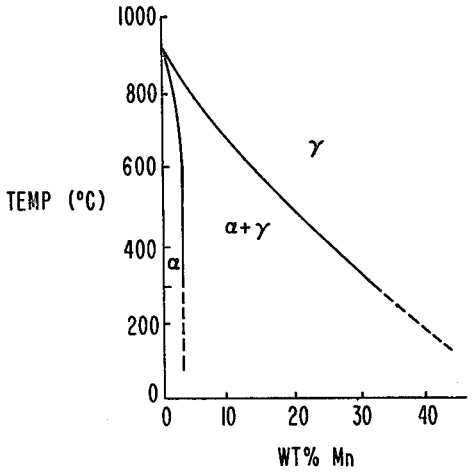
FIG. 1 shows phases as a function of temperature and manganese contents of Fe-Mn alloys.

In accordance with the invention, it has been realized that Fe-Mn alloys which preferably comprise Fe and Mn in a combined amount of at least 98 weight percent and Mn in an amount in the range of 3–25 weight percent of such combined amount, can be produced to have desirable semihard magnet properties. Such semihard magnet properties are conveniently defined by remanent magnetic induction $B_r$ greater than 7000 gauss and squareness ratio $B_r/B_s$ greater than 0.7. Alloys having such properties are suited for use in magnetically actuated devices which may be conveniently characterized in that they comprise a component whose position is dependent on strength, direction, or presence of a magnetic field and further in that they comprise means such as, e.g., an electrical contact for sensing the position of such component. Alloys of the invention may comprise small amounts of additives such as, e.g., Cr for the sake of enhanced corrosion resistance, or Co for the sake of enhanced magnetic properties; however, excessive amounts of Cr may be detrimental to magnetic properties. Other elements such as, e.g., Ni, Si, Al, Cu, Mo, V, Ti, Nb, Zr, Ta, Hf, and W may be present as impurities in individual amounts preferably less than 0.2 weight percent and in a combined amount preferably less than 1 weight percent. Similarly, elements C, N, S, P, B, H, and O are preferably kept below 0.1 weight percent individually and below 0.5 weight percent in combination. Minimization of impurities is in the interest of maintaining alloy formability for development of anisotropic structure as well as for shaping into desired form. Excessive amounts of elements mentioned may also lead to inferior magnetic properties.

Magentic alloys of the invention possess anisotropic multiphase grain and microstructure in which particles and grains having preferred aspect ratio of at least 8 and preferably at least 30. Aspect ratio may conveniently be defined as length-to-diameter ratio when deformation is uniaxial such as, e.g., by wire drawing, and as length-to-thickness ratio when deformation is planar such as, e.g., by rolling. Preferred particle size is less than 8000 Angstrom and preferably less than 2000 Angstrom. Submicron structure may be conveniently determined, e.g., by electron microscopy.

Remanent magnetic induction $B_r$ of alloys of the invention is approximately linearly dependent on Mn content of alloys. Specifically, remanent magnetic induction of alloys of the invention equals or exceeds a value which may be expressed by the approximate formula $B_r$(gauss)=20,000–500×(weight percent Mn). Squareness ratio $B_r/B_s$ of alloys of the invention is typically greater than or equal to 0.95 and magnetic coercivity is in the range of 1–500 oersted.

Alloys of the invention may be prepared, e.g., by casting from a melt of constituent elements Fe and Mn in a crucible or furnace such as, e.g., an induction furnace; alternatively, a metallic body having a composition within the specified range may be prepared by powder metallurgy. Preparation of an alloy and, in particular, preparation by casting from a melt calls for care to guard against inclusion of excessive amounts of impurities as may originate from raw materials, from the furnace, or form the atmosphere above the melt. To minimize oxidation or excessive inclusion of nitrogen, it is desirable to prepare a melt with slag protection, in a vacuum, or in an inert atmosphere.

Cast ingots of an alloy of the invention may typically be processed by hot working, cold working, and solution annealing for purposes such as homogenization, grain refining, shaping, or the development of desirable mechanical properties.

Processing to achieve desirable anisotropic structure such as elongated grains and crystallographic texture may be carried out by various combinations of sequential processing steps. A particularly effective exemplary processing sequence may be specified by reference to FIG. 1 and comprises processing at temperatures corresponding to a two-phase region in the phase diagram by () initial plastic deformation, (2) initial aging, resulting in essentially two-phase decomposition, (3) plastic deformation, and (4) final aging.

Initial plastic deformation preferably is by an amount corresponding to at least 50 percent area reduction and may be at temperatures in the range of from −196 degrees C. (the temperature of liquid nitrogen) to 600 degrees C. Such deformation may serve several purposes and, in particular, it may help in transforming undesirable nonmagnetic gamma or epsilon phases to a magnetic alpha-prime phase especially for high Mn alloys. Also, initial plastic deformation may enhance the kinetics of initial two-phase alpha-plus-gamma decomposition and help to produce uniform, fine scale, isotropic two-phase structure. At this point, particle size may typically be in the neighborhood of 3,000 to 10,000 Anstrom. Initial deformation may be uniaxial as, e.g., by rod rolling, extrusion, wire drawing, or swaging; alternatively, deformation may be by methods such as, e.g., cross rolling or cold rolling. If deformation is carried out at a temperature above room temperature, the alloy may subsequently be air cooled or water quenched.

Figure 2:
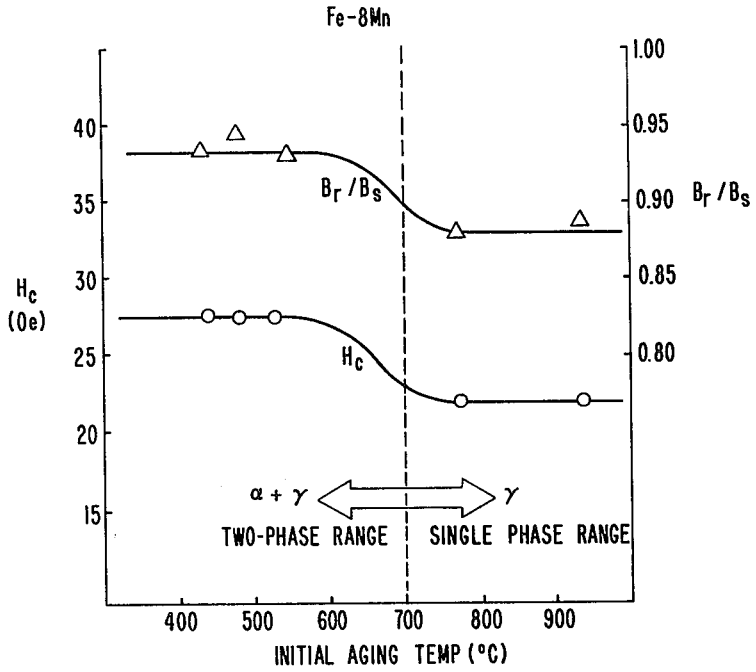
FIG. 2 shows magnetic properties of an Fe-8 Mn alloy as a function of a first aging temperature.

Heat treatment after initial deformation is preferably effected at temperatures corresponding to an alpha-plus-gamma two-phase state of the alloy. Particularly suited, according to FIG. 2, are temperatures in the general range of 400–600 degrees C. Duration of such heat treatment is preferably at least 30 minutes. Subsequent cooling to a temperature near or below room temperature may result in transformation of gamma phase partially or totally to alpha prime phase or epsilon phase.

Isotropic grains and fine scale structure produced upon two-phase decomposition are subsequently deformed, preferably uniaxially such as, e.g., by wire drawing, rod drawing, swaging, or extruding. As compared with swaging, wire drawing was found to result in superior magnetic properties. Planar deformation such as, e.g., by rolling is not precluded. Deformation may be effected at room temperature or at any temperature in the range from −196 to 600 degrees C. Preferred amounts of deformation correspond to an area reduction of at least 80 percent and preferably at least 95 percent, ductility adequate for such deformation being assured by limiting the presence of impurities and, in particular, of elements of groups 4b and 5b of the periodic table such as, Ti, Zr, Hf, V, Nb, and Ta. After deformation, saturation magnetization $B_s$(gauss) of the alloy is typically greater than or equal to a value of 20,000–500×(weight percent Mn).

Figure 3:
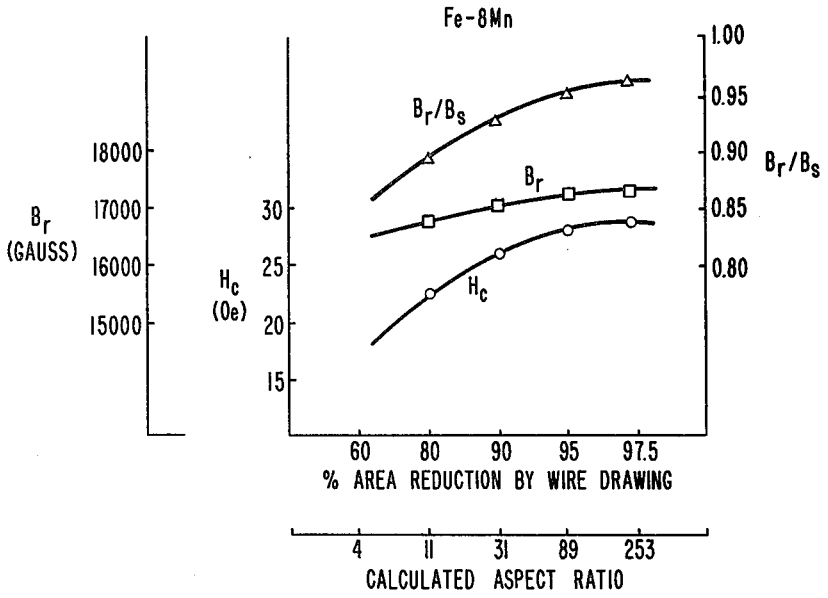
FIG. 3 shows magnetic properties of an Fe-8 Mn alloy as a function of cross-sectional area reduction by wire drawing.
Figure 4:
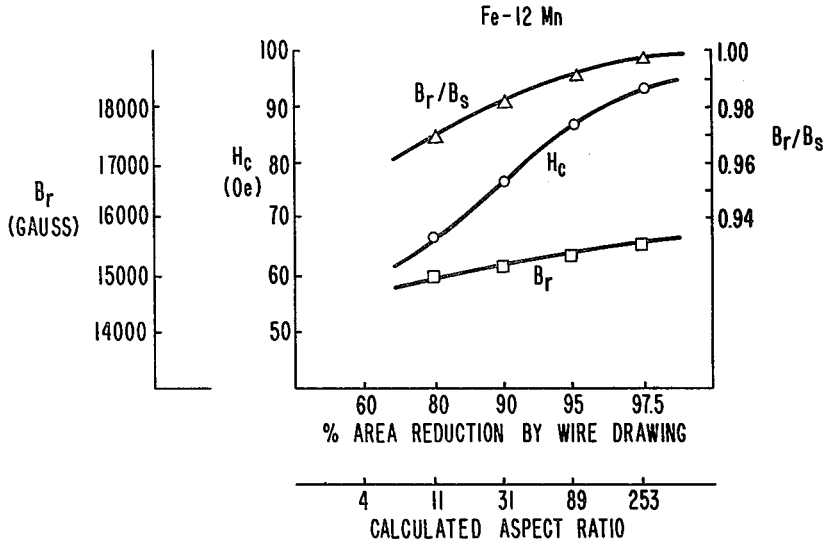
FIG. 4 shows magnetic properties of an Fe-12 Mn alloy as a function of cross-sectional area reduction by wire drawing.

Ultimate magnetic properties improve as the amount of deformation is increased; this is illustrated in FIG. 3 for an Fe-Mn alloy comprising 8 weight percent Mn and in FIG. 4 for an Fe-Mn alloy comprising 12 weight percent Mn. Calculated aspect ratio shown in FIGS. 3 and 4 is defined as grain length divided by grain diameter. Alloys of the invention remain highly ductile even after severe deformation such as, e.g., by cold wire drawing resulting in 95 percent area reduction. Such deformed alloys may be further shaped, e.g., by bending or flattening without risk of splitting or cracking. Bending may produce a change of direction of up to 30 degrees with bend radius not exceeding thickness. For bending through larger angles, safe bend radius may increase linearly to a value of 4 times thickness for a change of direction of 90 degrees. Flattening may produce a change of width-to-thickness ratio of at least a factor of 2.

Figure 5:
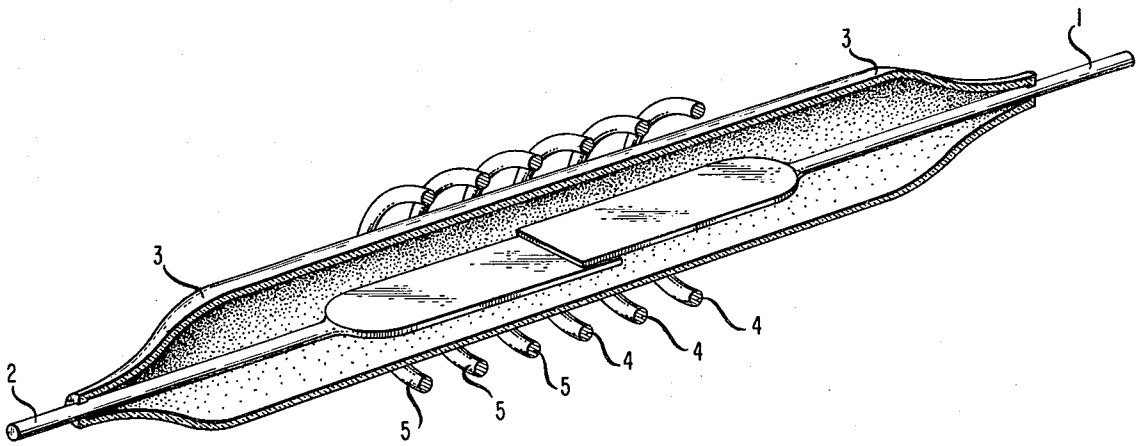
FIG. 5 shows a reed switch assembly comprising Fe-Mn reeds.

High formability in the wire-drawn state is of particular advantage in the manufacture of devices such as reed switches exemplified in FIG. 5 which shows reeds 1 and 2 made of an Fe-Mn alloy and extending through glass encapsulation 3 which is inside magnetic coils 4 and 5. Formability is enhanced by minimization of the presence of impurities and, in particular, of elements of groups 4b and 5b of the periodic table such as Ti, Zr, Hf, V, Nb and Ta.

After plastic deformation of a multiphase structure, a final low temperature aging heat treatment within an alpha-plus-gamma two-phase region is given. Typical aging temperatures are in the range of 350–500 degrees C. depending on Mn contents, and aging time is preferably in the range of from 10 minutes to 4 hours. Final aging enhances squareness $B_r/B_s$ of the B-H loop as may be due to one or several of metallurgical effects such as, e.g., relief of internal stress caused by deformation. Squareness may also be enhanced by partial or total reverse martensitic transformation of an Mn-rich phase which was formed during initial isothermal decomposition in a alpha-plus-gamma region and which subsequently was transformed partially or fully to magnetic alpha-prime phase in the course of final deformation. Furthermore, enhance squareness may be due to the presence of nonmagnetic or weakly magnetic gamma or epsilon phases that may serve as a desirable barrier for the demagnetization process, or to formation of a thin layer of nonmagnetic or weakly magnetic gamma phase having higher Mn content along the grain boundaries of the elongated two-phase structure. Rate of cooling to room temperature after annealing or aging heat treatments is not critical; either air cooling or water quenching may be used.

Among benefits of Fe-Mn semihard alloys according to the invention are the following: (1) high magnetic squareness as is desirable in switching and other magnetically actuated devices, (2) abundance and low cost of constituent elements Fe and Mn, (3) ease of processing and forming due to high formability, (4) low magnetostriction as may be specified by a saturation magnetostriction coefficient not exceeding $5\times10^{-6}$ and preferably not exceeding $2\times10^{-6}$ as may be desirable, e.g., to prevent sticking of reed contacts, (5) simplicity of binary composition resulting in ease of meeting magnet tolerances such as, e.g., nominal coercivity, and (6) ease of plating with contact metal such as gold.

Magnetic properties realized in the following alloys of the invention are shown in Table I.

EXAMPLE 1

An Fe-8 Mn alloy was hot rolled, cold rolled, cold shaped into a 0.21 inch diameter rod, annealed at 900 degrees C. for 1 hour, and air cooled. The sample was cold worked (90 percent area reduction) into 0.067 inch diameter wire and given an initial aging treatment at 500 degrees C. for 3.5 hours resulting in two-phase alpha-plus-gamma decomposition and recrystallization. The decomposed isotropic grain size was uniformly fine and average grain size was smaller than 1 micrometer in diameter. The sample was then drawn (95 percent area reduction) to 15 mil diameter wire, was given a final aging heat treatment at 450 degrees C. for 3 hours, and was air cooled. Magnetostriction of this sample was determined to be approximately $1.3\times10^{-6}$.

EXAMPLE 2

A 0.067 inch diameter wire sample of Fe-8 Mn alloy was prepared and cold worked as in Example 1, given an initial aging heat treatment at 550 degrees C. for 3.5 hours resulting in alpha-plus-gamma two-phase decomposition, wire drawn (95 percent area reduction), given a final aging heat treatment at 400 degrees C. for 40 minutes, and air cooled.

EXAMPLE 3

An Fe-7.5 Mn alloy sample was prepared and processed as in Example 1.

EXAMPLE 4

An Fe-12 Mn alloy sample was hot rolled, cold rolled, cold shaped into 0.210 inch diameter rod, annealed at 930 degrees C. for 1 hour, and water cooled. The sample was further cold drawn (90 percent area reduction) into 0.067 diameter wire and was given an initial aging heat treatment at 550 degrees C. for 3.5 hours causing two-phase alpha-plus-gamma decomposition and recrystallization. The isotropically grained, submicron fine two-phase structure was then drawn (95 percent area reduction) to 15 mil diameter wire, was given a final aging heat treatment at 450 degrees C. for 40 minutes, and was air cooled.

EXAMPLE 5

An Fe-12 Mn alloy sample was prepared as in Example 4, except that final aging was at 400 degrees C. for 40 minutes.

EXAMPLE 6

An Fe-12 Mn alloy sample was prepared as in Example 4, except that initial aging was performed at 500 degrees C. for 3.5 hours and final aging at 450 degrees C. for 10 minutes. Magnetic energy product of this sample was determined to be approximately 0.96 MGOe.

EXAMPLE 7

An Fe-12 Mn alloy sample was prepared as in Example 4, except that initial aging was conducted at 450 degrees C. for 16 hours and final aging at 450 degrees C. for 40 minutes. Magnetic energy product of this sample was determined to be approximately 1.05 MGOe.

EXAMPLE 8

An Fe-12 Mn alloy sample was prepared as in Example 7, except that the amount of final wire drawing resulted in 90 percent area reduction.

TABLE I

Magnetic Properties of Square-Loop, High Remanence, Fe—Mn Semihard Magnet Alloys.

| Example | $B_r$ (gauss) | $B_r/B_s$ | $H_c$ (oersted) |
|---|---|---|---|
| 1 | 17200 | 0.94 | 28 |
| 2 | 17300 | 0.90 | 26 |
| 3 | 18100 | 0.96 | 25 |
| 4 | 15200 | 0.997 | 67 |
| 5 | 16700 | 0.968 | 63 |
| 6 | 15400 | 0.992 | 87 |
| 7 | 15300 | 0.989 | 85 |
| 8 | 15800 | 0.954 | 60 |

I claim:

1. Magnetic alloy comprising an amount of at least 98 weight percent Fe and Mn, Mn being in the range of 3–25 weight percent of said amount, magnetic induction $B_r$ of said alloy being greater than or equal to a value which depends on weight percent Mn comprised in said amount, said value being defined in gauss by the approximate formula 20,000–500×(weight percent Mn), magnetic squareness ratio of said alloy being greater than or equal to 0.95, and said alloy having uniaxially deformed anisotropic two-phase or multiphase microstructure and grain structure, particle length-to-diameter ratio in said microstructure being greater than or equal to 8.

2. Alloy of claim 1 in which said aspect ratio is greater than or equal to 30.

3. Alloy of claim 1 in which said alloy has microstructure in which particle diameter is less than or equal to 8000 Angstrom.

4. Alloy of claim 3 in which said diameter is less than or equal to 2000 Angstrom.

5. Alloy of claim 1 in which said alloy has a magnetostriction coefficient less than or equal to $5\times10^{-6}$.

6. Alloy of claim 1 in which said coefficient is less than or equal to $2\times10^{-6}$.

* * * * *